US006742876B2

(12) United States Patent
Enz

(10) Patent No.: US 6,742,876 B2
(45) Date of Patent: Jun. 1, 2004

(54) EYELID OPERATION FOR AN INK JET PRINTER

(75) Inventor: Richard Troy Enz, Dayton, OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 7 days.

(21) Appl. No.: 10/062,142

(22) Filed: Jan. 31, 2002

(65) Prior Publication Data

US 2003/0156168 A1 Aug. 21, 2003

(51) Int. Cl.[7] ..... B41J 2/02; B41J 2/165
(52) U.S. Cl. ..... 347/75; 347/22
(58) Field of Search ..... 347/75, 49, 29, 347/22, 73–74, 34

(56) References Cited

U.S. PATENT DOCUMENTS 5,455,611 A * 10/1995 Simon et al. ..... 347/49
2003/0081046 A1 * 5/2003 Enz ..... 347/25

* cited by examiner

*Primary Examiner*—Lamson Nguyen
*Assistant Examiner*—K. Feggins
(74) *Attorney, Agent, or Firm*—Barbara Joan Haushalter

(57) ABSTRACT

A system and method are provided for improving the reliability for operation of the eyelid associated with the ink jet printhead of a continuous ink jet printer. The eyelid actuation technique of the present invention solves the problem of ink jet fluid residue drying in or around the seal region between the eyelid and the catcher. This is accomplished by opening the eyelid at least once during the shutdown sequence of the printhead, while maintaining vacuum on the catcher throat. By opening the eyelid in this manner, the capillary forces that had held the ink jet fluid at the seal region are eliminated. The vacuum on the catcher throat then causes air to rush in through the gap between the catcher pan and the eyelid. Residual ink jet fluid at the seal region on both the eyelid and the catcher pan is then removed by the high velocity air moving through the gap.

14 Claims, 2 Drawing Sheets

EYELID OPERATION FOR AN INK JET PRINTER

TECHNICAL FIELD

The present invention relates to continuous ink jet printing and, more particularly, to a means for preventing the eyelid of an ink jet printhead from sticking shut and not operating properly after a completed shutdown.

BACKGROUND ART

Current ink jet printing systems consist of a fluid system supporting one or more printheads. Typical ink jet printheads operate by forcing fluid through a droplet generator which contains an array of orifices, forming droplets of ink. The printhead is fully supported by the fluid system, controlling different solenoid valves and pumps to perform necessary functions for the printhead to operate reliably. These functions include cleaning, startup, and shutdown. One particular function, shutdown, provides a means to stop operation of the printhead and fluid system over an extended period of time and allow for returned operation. At shutdown, the ink floods the leads and the area around the orifices. Flushing fluid and/or ink then dries, leaving behind non-volatile components in the form of solids or gels. Upon subsequent startups, the failure to remove or redissolve all of this material in the orifice and gap between the orifice plate and charge plate creates disturbances in the shape or direction of the emerging jet.

In the existing art, continuous ink jet printheads have a component called an eyelid to catch ink droplets when starting up automatically. The eyelid typically has a rubber-like material for sealing, a heater, and operates in an open and close fashion to allow for printing. It has been seen that with some inks during an extend period of shutdown, days or weeks, residual ink left at the seal of the eyelid to the catcher can dry. This dried ink can impede or prevent the eyelid from opening at the subsequent start up, producing a failure.

It would be desirable, then, to have a improved reliable operation by solving the issue of failures in eyelid operation due to dried ink and ink fluid residues in between the eyelid seal and the catcher.

SUMMARY OF THE INVENTION

This need is met by the technique according to the present invention wherein by automatically actuating the eyelid during purge and dry states in the shutdown sequence, residual ink jet fluid is removed from the sealing surfaces, preventing it from essentially "gluing" the eyelid shut and causing a failure.

In accordance with one aspect of the present invention, a system and method are provided to improve reliability of operation for a continuous ink jet printer. This system and method is for preventing ink residue and purge fluid residue from impeding operation of an eyelid of a printhead in a continuous ink jet printing system, particularly at a seal region defined between the eyelid and the catcher. The eyelid is actuated to open at least once during purge and dry states of a shutdown sequence of the printhead. A vacuum is maintained on a catcher throat of the catcher to cause air to enter a gap between the catcher pan and the eyelid, whereby high velocity air moving through the gap removes residual ink jet fluid at the seal region on both the eyelid and the catcher pan.

It is an object of the present invention to provide a means to prevent the eyelid on an ink jet printer from sticking, due to dried ink or dried purge fluid, and causing a failure in operation of the printhead. It is another object of the present invention to provide a method of actuating the eyelid at different time intervals to flush and dry the eyelid seal and catcher of an ink jet printer, providing reliable operation after an extended period of down time.

Other objects and advantages of the present invention will be apparent from the following description and the appended claims.

DETAILED DESCRIPTION OF THE INVENTION

Figure 1:
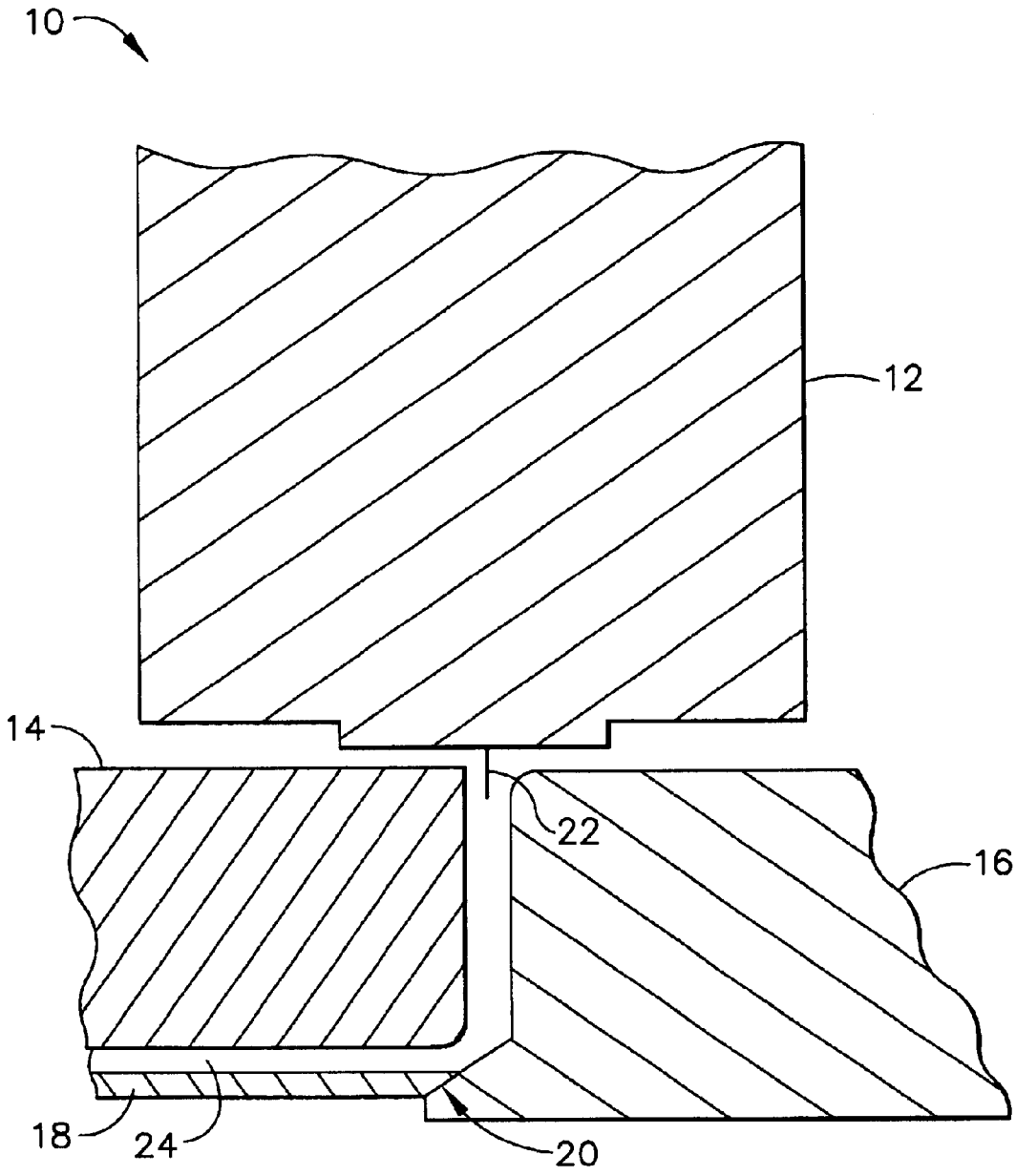
FIG. 1 illustrates a partial ink jet printing system configuration, wherein the eyelid is closed.

In accordance with the present invention, the eyelid of an ink jet printhead is prevented from sticking shut after a completed shutdown. Referring now to the drawings, FIG. 1 illustrates a cross section of a portion of a continuous ink jet printhead 10, including part of a drop generator 12, catcher 14, and eyelid 16. The eyelid 16 provides a seal against the bottom of the catcher 14 to prevent ink from exiting the printhead when the system is not in the printing mode. In FIG. 1, the eyelid 16 is in the closed position, sealing against the catcher pan 18 of catcher 14, at seal region 20. In this position, ink which may be jetted, as indicated by reference number 22, from the drop generator during the startup or shutdown sequences, would strike the lower portion of the eyelid 16 and be diverted into catcher throat 24. Vacuum on the catcher throat 24 then returns the ink to the fluid system reservoir, not shown.

Figure 2:
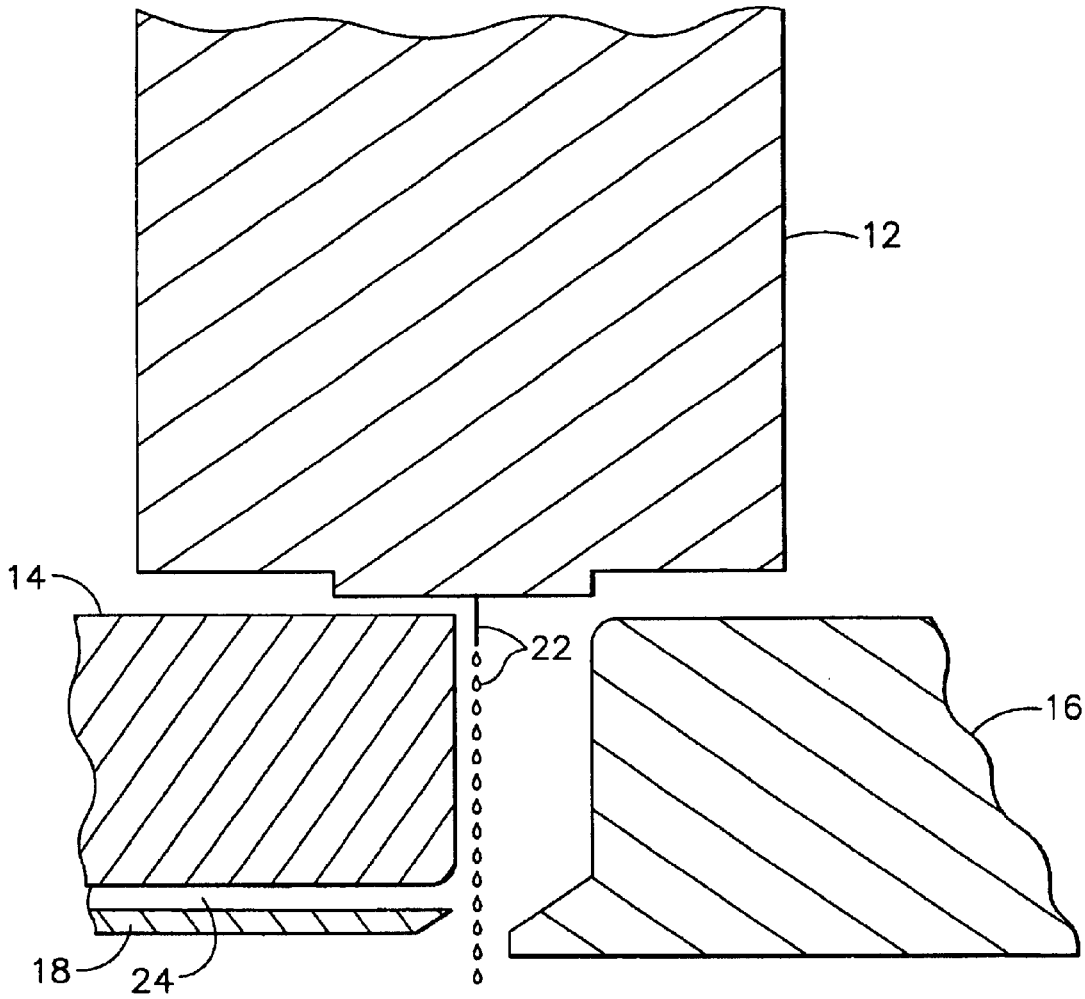
FIG. 2 illustrates the partial ink jet printing system configuration of FIG. 1, wherein the eyelid is open.

To print, the eyelid 16 is retracted, as shown in FIG. 2. The ink jetted 22 from the drop generator 12 can now pass between the catcher 14 and the eyelid 16, allowing the ink to be printed. Use of charging and deflection means, not shown, at the top of the catcher 14, allows only select drops jetted from the drop generator to print. The remainder of the drops are deflected onto the face of the catcher 14. The ink then flows down the catcher face and enters the catcher throat 24, from which it is returned to the fluid system reservoir.

During the shutdown sequence, when the eyelid 16 is in the closed position illustrated in FIG. 1, the charge and deflection means are deactivated. Ink from the drop generator 12 is diverted by the lower portion of the eyelid 16 into the catcher throat 24. The seal at 20 of the eyelid 16 to the catcher pan 18 prevents this ink from leaking from the printhead 10. The flow of ink to the drop generator is then stopped. Depending on the print system and the mode of shutdown, a purge state may be employed to pump a purge fluid through the drop generator to rinse away ink residues. During a purge state, some of the purge fluid may be allowed to flow out through the orifice to rinse off the exterior of the orifice plate and the face of the charge plate and catcher. After the flow of ink or purge fluid to the drop generator 12 has been stopped, there is a dry state in which vacuum is maintained on the catcher throat 24 to remove ink from the space between the catcher and the eyelid. It will be appreciated that although this period of vacuum on the catcher throat can remove the bulk of the ink from between the catcher and the eyelid, the capillary forces present at seal region 20 where the eyelid 16 seals against the catcher pan 18 can cause a small amount of ink to be retained at the seal region 20. During an extended period of shutdown, the ink at the seal region 20 can begin to dry. As the ink dries, it may become tacky or hard. Such tacky or hard ink can impede the normal motion to retract the eyelid, possibly resulting in a printhead failure. This problem is addressed by the present invention.

In accordance with the present invention, during the shutdown sequence after the vacuum on the catcher throat has removed the bulk of the ink from between the eyelid and the catcher, the eyelid actuator opens and closes the eyelid several times while maintaining vacuum on the catcher throat. This eyelid cycling eliminates the capillary forces that had held the ink at the seal region. The vacuum on the catcher throat then causes air to rush in through the gap between the catcher pan and the eyelid. Residual ink at the seal region 20 on both the eyelid and the catcher pan can then be removed by the high velocity air moving through the gap. The present invention therefore proposes opening the eyelid at least one time during the shutdown sequence while vacuum is on the catcher throat and the ink at the seal region is still wet. The capillary forces can be eliminated by opening the eyelid once, or repeatedly opening and closing the eyelid. One suitable eyelid cycling is shown in the state table information below. The eyelid cycling occurs toward the end of the shutdown sequence. During this period the fluid system vacuum, applied to the catcher throat, is set to 12 inches Hg. The eyelid is opened to its normal open position, as opposed to its service position.

| State # | Position | Time |
|---|---|---|
| <44 | closed | |
| 44 | open | 5 sec |
| 45 | closed | 5 sec |
| 46 | open | 5 sec |
| 47 | closed | 5 sec |
| 48 | open | 5 sec |
| 49 | closed | 5 sec |
| 50 | open | 2 sec |
| >50 | closed | |

In some embodiments, the eyelid may also be opened and closed earlier in the shutdown sequence, for example, during the purge portion of the shutdown. While there is a small amount of purge fluid present between the catcher and eyelid, and vacuum is not applied to the catcher throat, momentarily cracking open the eyelid can allow the purge fluid to re-dissolve ink at the seal region without allowing purge fluid to leak from the printhead. Redissolving the ink in this way, followed by opening the eyelid while drawing air into the catcher throat can further reduce the risk of dried ink impeding the eyelid motion.

Industrial Appllicability and Advantages

The present invention is useful in the operation of printheads in an ink jet printing system, particularly for high resolution printheads. The method and system of the present invention have the advantage of improving reliability of operation of printheads for a continuous ink jet printer, in particular, by preventing the eyelid on an ink jet printer from sticking due to dried ink, thereby possibly causing a failure in operation. The eyelid can be actuated at different time intervals to flush and dry the eyelid seal and catcher of an ink-jet printer, providing reliable operation after an extended period of downtime.

The invention has been described in detail with particular reference to certain preferred embodiments thereof, but it will be understood that modifications and variations can be effected within the spirit and scope of the invention.

What is claimed is:

1. A method for preventing ink jet fluid residue from impeding operation of an eyelid of a printhead in a continuous ink jet printing system, the printhead having an associated drop generator and catcher with catcher pan, whereby a seal region is defined between the eyelid and the catcher, the method comprising the steps of:

actuating the eyelid to open at least once during purge and dry states of a shutdown sequence of the printhead; and maintaining vacuum on a catcher throat of the catcher to cause air to enter a gap between the catcher pan and the eyelid, whereby high velocity air moving through the gap removes residual ink jet fluid at the seal region on both the eyelid and the catcher pan.

2. A method as claimed in claim 1 wherein the step of actuating the eyelid to open at least once further comprises the step of actuating the eyelid in accordance with a predetermined cycling to prevent ink jet fluid residue from drying at the seal region when the eyelid is closed.

3. A method as claimed in claim 2 wherein the step of actuating the eyelid in accordance with a predetermined cycling further comprises the step of initiating the predetermined cycling later than half way through the shutdown sequence.

4. A method as claimed in claim 3 wherein the step of actuating the eyelid in accordance with a predetermined cycling further comprises the step of setting a fluid system vacuum, applied to the catcher throat, to approximately 12 inches Hg.

5. A method as claimed in claim 1 wherein the step of actuating the eyelid to open at least once comprises the step of opening the eyelid to a normal open position, as opposed to a service position.

6. A method as claimed in claim 1 wherein the step of actuating the eyelid further comprises the step of eliminating capillary forces that had held ink jet fluid at the seal region.

7. A method as claimed in claim 1 wherein the step of actuating the eyelid further comprises the step of actuating the eyelid when the ink jet fluid at the seal region is still wet.

8. A system for preventing ink jet fluid residue from impeding operation of an eyelid of a printhead in a continuous ink jet printing system, the printhead having an associated drop generator and catcher with catcher pan, whereby a seal region is defined between the eyelid and the catcher, the system comprising:

means for actuating the eyelid to open at least once during purge and dry states of a shutdown sequence of the printhead; and means for maintaining a vacuum on a catcher throat of the catcher to cause air to enter a gap between the catcher pan and the eyelid, whereby high velocity air moving through the gap removes residual ink jet fluid at the seal region on both the eyelid and the catcher pan.

9. A system as claimed in claim 8 wherein the means for actuating the eyelid to open at least once further comprises means for actuating the eyelid in accordance with a predetermined cycling to prevent ink jet fluid residue from drying at the seal region when the eyelid is closed.

10. A system as claimed in claim 9 wherein the means for actuating the eyelid in accordance with a predetermined cycling further comprises means for initiating the predetermined cycling later than half way through the shutdown sequence.

11. A system as claimed in claim 10 wherein the means for actuating the eyelid in accordance with a predetermined cycling further comprises means for setting a fluid system vacuum, applied to the catcher throat, to approximately 12 inches Hg.

12. A system as claimed in claim 8 wherein the means for actuating the eyelid to open at least once comprises means for opening the eyelid to a normal open position, as opposed to a service position.

13. A system as claimed in claim 8 wherein the means for actuating the eyelid further comprises means for eliminating capillary forces that had held ink jet fluid at the seal region.

14. A system as claimed in claim 8 wherein the means for actuating the eyelid further comprises means for actuating the eyelid when the ink jet fluid at the seal region is still wet.

* * * * *